US011267535B2

(12) United States Patent
Platè et al.

(10) Patent No.: US 11,267,535 B2
(45) Date of Patent: Mar. 8, 2022

(54) MOORING BUOY

(71) Applicants: Bonfiglio Platè, Rivergaro (IT); Luca Francesco Maria Rovere, Piacenza (IT); Paolo Saltarelli, Vigolzone (IT)

(72) Inventors: Bonfiglio Platè, Rivergaro (IT); Luca Francesco Maria Rovere, Piacenza (IT); Paolo Saltarelli, Vigolzone (IT)

( * ) Notice: Subject to any disclaimer, the term of this patent is extended or adjusted under 35 U.S.C. 154(b) by 77 days.

(21) Appl. No.: 16/761,997

(22) PCT Filed: Nov. 7, 2018

(86) PCT No.: PCT/IB2018/058746
§ 371 (c)(1),
(2) Date: May 6, 2020

(87) PCT Pub. No.: WO2019/092612
PCT Pub. Date: May 16, 2019

(65) Prior Publication Data

US 2020/0317301 A1 Oct. 8, 2020

(30) Foreign Application Priority Data

Nov. 8, 2017 (IT) ..... 102017000127446

(51) Int. Cl.
*B63B 22/02* (2006.01)
*B63B 22/20* (2006.01)

(52) U.S. Cl.
CPC ..... *B63B 22/023* (2013.01); *B63B 22/20* (2013.01)

(58) Field of Classification Search
CPC ..... B63B 22/00; B63B 22/02; B63B 22/023; B63B 22/18; B63B 22/20; B63B 22/28
(Continued)

(56) References Cited

U.S. PATENT DOCUMENTS 4,138,751 A * 2/1979 Kentosh ..... F16L 39/04 114/230.13
5,129,848 A * 7/1992 Etheridge ..... B63B 22/06 441/2

(Continued)

FOREIGN PATENT DOCUMENTS

JP 2011-116150 9/2011
WO WO 2004/032064 4/2004

(Continued)

OTHER PUBLICATIONS

International Search Report, PCTIB2018/058746, dated Feb. 21, 2019.

*Primary Examiner* — Daniel V Venne
(74) *Attorney, Agent, or Firm* — Nixon & Vanderhye

(57) ABSTRACT

A mooring buoy includes a first floating body, a second body slidingly connected to the first and normally submerged, a mooring line connected to the second body by a connector housed in a seat in the first body and movable between a retracted position and a protruding position, enabling fixing the mooring line. The buoy further includes at least one chamber, in one or both of the first and second bodies, a fluid circuit admitting fluid into and out of the chamber, and a control unit connected to the fluid circuit. The control unit controls the fluid circuit to vary the amount of the fluid in the chamber, causing a variation of the immersion depth of the first body with respect to the second body or vice versa and, consequently, movement of the connecting element between the retracted and protruding positions.

20 Claims, 10 Drawing Sheets

(58) Field of Classification Search
USPC ..... 441/1, 3
See application file for complete search history.

(56) References Cited

U.S. PATENT DOCUMENTS

| | | | | |
|---|---|---|---|---|
| 6,109,989 | A * | 8/2000 | Kelm | B63B 22/021 441/4 |
| 6,406,222 | B1 * | 6/2002 | Pollack | B63B 21/502 405/224 |
| 2009/0298366 | A1 | 12/2009 | Scarcello | |
| 2010/0227517 | A1 | 9/2010 | Bailey | |
| 2016/0340001 | A1 | 11/2016 | Welch | |
| 2017/0158249 | A1 | 6/2017 | Daniels et al. | |

FOREIGN PATENT DOCUMENTS

| | | |
|---|---|---|
| WO | WO 2011/096901 | 8/2011 |
| WO | WO 2016/015089 | 2/2016 |

* cited by examiner

MOORING BUOY

BACKGROUND OF THE INVENTION

Field of the Invention

The present invention concerns a mooring buoy destined, in particular, for use in a buoy field. More in detail, the invention relates to a buoy provided with a connecting element, to which to connect a line of a vessel or of a boat, adapted to move between a retracted position, in which it is not accessible, and a protruding position, in which it enables connection of said line to the buoy.

Description of the Related Art

In recent years the installation of buoy fields in proximity of the coast has become increasingly widespread, especially in marine parks or in areas of particular natural beauty.

Buoy fields, or mooring fields, are areas adjacent to the coast equipped with a plurality of buoys that enable a boater to moor a vessel to the mooring.

Buoy fields have been designed to protect the seabed and marine vegetation, where the use of an anchor to moor the vessel can cause noteworthy damage to the seabed, especially in protected marine areas.

In the description below the term vessel will refer generically to a vessel, to a boat or a ship, as classified according to Italian legislation.

Buoy fields can be free, i.e., vessels can moor free of charge without particular restrictions, or, more frequently, a fee can be required.

For this second type of buoy field "intelligent" buoys have been developed, enabling the manager to control and manage booking of the mooring, and to check any unauthorized mooring, and the user to book and pay for the mooring in a practical and quick way.

Examples of these buoys are described in WO 2004/032064 A1, JP 2011-116150 A, WO 2016/015089 A1 and US 2017/0158249 A1.

A problem that managers of private or public buoy fields for which a fee is required have to tackle is that of controlling and preventing the mooring of unauthorized vessels, i.e., subjects that have not booked or paid for the buoy or that moor where there is a specific ban.

For this purpose, some prior art buoys are equipped with sensors capable of detecting whether a vessel is moored, and of sending this information to a control station.

However, this system does not prevent a subject from attempting to moor a vessel without the relevant authorization. In these cases, with prior art buoys, the manager may become aware of the event in real time; however, to remove the unauthorized vessel, personnel must be sent to the buoy in question, with all the problems this implies in terms of times and costs.

WO 2011/096901 A1 describes a mooring buoy provided with a mobile eyelet accessible through an opening in the body of the buoy and operated by a mechanism connected to a control unit that manages access to mooring to the buoy. The opening in the body of the buoy can however allow water to enter it, which could damage the electronic or mechanical components, including the mechanism for movement of the eyelet.

Therefore, in this field there is the need to provide a mooring buoy to be used in a buoy field or the like, which allows the aforesaid limits of the prior art to be overcome.

SUMMARY OF THE INVENTION

It is therefore an object of the present invention to provide a mooring buoy equipped with a system for connecting the line of a vessel that only allows authorized vessels to moor.

In particular, an object of the invention is to propose a buoy provided with movable and retractable connecting element that are made accessible only following an authorization or authentication procedure carried out by the boater.

Another object of the present invention is to provide a mooring buoy that makes the operation to connect the line to the buoy and release it therefrom more practical and convenient, even for vessels of large size, for example of over 15 meters.

Yet another object of the present invention is to produce a reliable mooring buoy that does not require frequent maintenance operations.

These objects are achieved by a mooring buoy comprising:

a first body capable of floating;

a second body placed under the first body, said first and second bodies being slidingly connected, said second body being normally submerged when the buoy is in use and in the rest position; and a connecting element connected to the second body and fixable to a line of a vessel to be moored to the buoy, said connecting element being housed in a seat produced in the first body and being movable, due to the effect of the movement of the first or of the second body, between a retracted position, in which it returns into the profile of the first body, and a protruding position, in which it protrudes from the top end of the first body thereby enabling the line to be fixed to the buoy.

In general, the second body is placed under the first body when the buoy is in a rest position, i.e., is substantially vertical. Said second body therefore moves with respect to the first along a sliding axis, preferably substantially vertical.

In accordance with the invention, the buoy further comprises at least one chamber located in the first body or in the second body. If necessary, at least one chamber can be provided both in the first and in the second body. The chamber can in turn comprise various compartments, which may or not be in fluid communication with one another.

The buoy is equipped with a fluid circuit adapted to enable fluid, generally air or water or both, to be fed into the chamber or, vice versa, removal of said fluid toward the outside of the buoy.

According to the invention, the variation of the amount of said fluid in the aforesaid chamber causes a variation of the immersion depth of the first body with respect to the second body or vice versa and, consequently, movement of the connecting element between the aforesaid retracted and protruding positions.

The fluid circuit is connected to a control unit that commands its operation in order to control the amount of the fluid in the chamber.

According to the invention the fluid circuit can generally comprise pumping means, such as pumps, compressors or the like, tanks for storing the treated fluid and valves, for example pneumatic or electric to control the movement of the fluid in the circuit.

These components of the fluid circuit can therefore be managed by the control unit as a function of commands issued by a user or controller, as described in more detail below.

In the present description, "buoy in use" means a buoy in water, regardless of the fact that the buoy is free or a vessel is tied to it, and "rest position" of the buoy means that the buoy is in use, but no vessel is moored to the buoy.

In the buoy in use said first body is floating, i.e., at least one portion thereof emerges from the surface of the water.

When the buoy is free, i.e., without a vessel moored to it, the connecting element can be maintained in the retracted position. In this condition it is not possible for a line or any other means to moor a vessel to be connected to it.

When an authorization command is sent to the control unit, as will be described in more detail below, this latter controls the fluid circuit to fill the chamber or to empty the fluid from it and therefore move the first body or the second body and the connecting element.

According to the invention, variation of the amount of the fluid in the chamber can either cause a variation of the weight of the body in which it is located or a variation of its volume.

In both cases, said variations of the property of the body influence its ability to float and therefore its immersion depth.

In the first case the volume of the body in the which the chamber is located is typically fixed. Variation of its weight therefore causes sinking to a greater or lesser extent.

Instead, in the second case the weight of the body is generally substantially constant. Variation of the volume causes a larger or smaller buoyancy force that acts thereon and, therefore, sinking to a greater or lesser extent.

According to a possible embodiment of the invention, the fluid fed into the chamber comprises or consists of air or another gas. According to this variant the chamber has a variable volume and is delimited by one or more walls at least partially submerged or in any case directly in contact with the water in which the buoy is immersed.

According to this variant, the fluid circuit comprises pumping means to feed compressed air into the chamber. The introduction or extraction of air into or from the chamber determines a variation of its volume and, therefore, a variation of the volume of the body which, receiving greater buoyancy, rises toward the first body. Said movement of the second body in turn causes movement of the connecting element which, exiting from its seat and protruding from the top end of the first body, becomes accessible for connection of a line or other means that allows mooring of the vessel.

In the case in which the chamber is in the first body, its emptying, i.e., extraction of air, causes a reduction of its volume, and therefore of the buoyancy force, which causes the first body to sink and move toward the second.

In this variant, the second body is immersed at a more or less constant depth so that sinking of the first body gradually releases the connecting element from the seat in the first body, making it accessible.

According to a preferred aspect of the invention, said chamber with variable volume can comprise one or more walls made of a flexible and even elastic material. For example, the chamber can be a bag made of this material with at least one opening for introducing and extracting air. Said flexible and even elastic wall can be fixed to the connecting element directly or by means of a rigid support element. Said connecting element may or may not be one of the walls of the chamber.

However, the chamber can comprise two or more rigid bodies connected and movable in relation to one another so as to vary the total volume.

According to another embodiment of the invention, the chamber can be filled with a liquid, typically water or the like. According to this variant the body in which the chamber is located has a constant volume. The chamber can also have a fixed or variable volume. In this second case the chamber is arranged in the body so that variation of its volume does not influence the volume of this latter.

According to this variant, if the chamber is housed in the second body, its emptying causes a decrease in the weight of this latter and, consequently, it rises together with the connecting element. As explained above, the connecting element protrudes from its seat beyond the top end of the first body and becomes accessible for connection of the means that enable mooring of the vessel.

Instead, in the case in which the chamber is in the first body, when it is filled with water its weight increases causing the first body to sink toward the second. Also in this case, this latter is maintained immersed at a more or less constant depth so that sinking of the first body releases the connecting element from its seat.

According to this variant, the fluid circuit is therefore configured to allow water to be fed into the chamber and removed therefrom.

According to a first embodiment the circuit comprises pumping means adapted to pump water from the inside of the chamber toward the outside or, if necessary, also from outside the buoy toward the inside of the chamber.

Therefore, in the first case said pumping means are used only to empty the water from the chamber. Filling, i.e., the feed of water, can instead take place by exploiting the external overpressure caused by partial or total immersion of the body in the water. If necessary, the pumping means can also be used to fill the aforesaid chamber.

According to another embodiment, said pumping means can be configured to introduce compressed air into the chamber. In this way, the increase in pressure inside the chamber causes the removal of any water present inside it through a specific passage. In this case, filling can take place naturally, as explained above, or with fluid pumping means.

According to an aspect of the invention, the first body and the second body are connected by a rod, solidly connected to the second body and sliding in a cavity produced in the first body.

The connecting element is connected to said rod and is preferably located at a top end thereof. The connecting element therefore moves together with the rod during the mutual movement of the two bodies, first and second.

Alternatively, the connecting element can be connected to the rod by means of a return mechanism or the like.

According to a preferred variant, the fluid circuit, or at least the pumping means, is/are located in the first body. Typically, also other components such as valves, tanks, etc. are placed in the first body.

In this way, as the first body is only partially submerged, these components are more shielded from contact with the water.

The chamber, when produced in the second body, is placed in communication with the fluid circuit through a pipe. This pipe is preferably wound in a spiral around the rod; in this way the pipe can extend and retract following the mutual movements of the first and second bodies.

The rod, which is preferably hollow, can accommodate any electrical cables or other elements that must be protected inside it. If necessary, also the pipe that connects the chamber in the second body to the pumping means in the first body can be housed inside the rod.

According to the invention the buoy can be controlled remotely by the boater via an electronic device, for example a smartphone, a tablet or the like, or from a control station of the buoy field.

For this purpose, the control unit is equipped with a wireless communication module, for example of Wi-Fi, mobile network (GPRS, 3G, 4G, etc.) or Bluetooth type.

The buoy is preferably equipped with a battery to power the electric or electronic components, such as the control unit, the communication module and the components of the fluid circuit. According to a preferred variant, the buoy is also equipped with solar panels to charge the aforesaid battery or, if necessary, to directly power the components on board. Therefore, the buoy produced is self-sufficient and does not require to be powered via submerged cables.

The battery, if present on board the buoy, is preferably located in the first body.

Alternatively, if a large capacity battery is required, it can be located in the deadweight of the buoy, placed on the bed of the body of water, so as not to encumber the first body with its weight.

BRIEF DESCRIPTION OF THE DRAWINGS

Further characteristics and advantages of the present invention will become more apparent from the description of an example of a preferred, but not exclusive, embodiment of a mooring buoy, as illustrated in the accompanying drawings, wherein.

DESCRIPTION OF THE PREFERRED EMBODIMENTS

Figure 1:
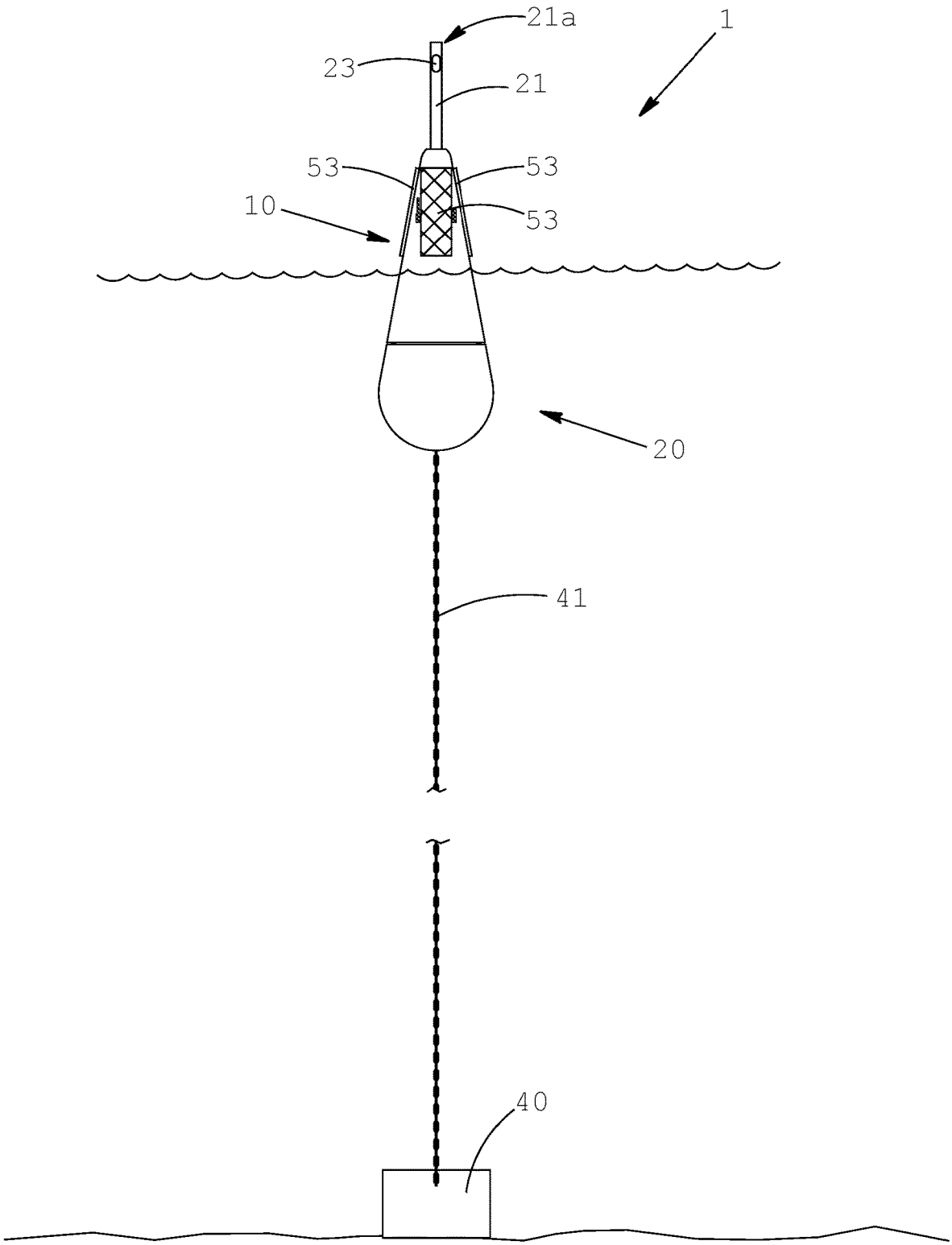
FIG. 1 is a side view of the buoy according to a variant of the invention, installed in a body of water and in a rest position, i.e., a condition with mooring available.
Figure 2:
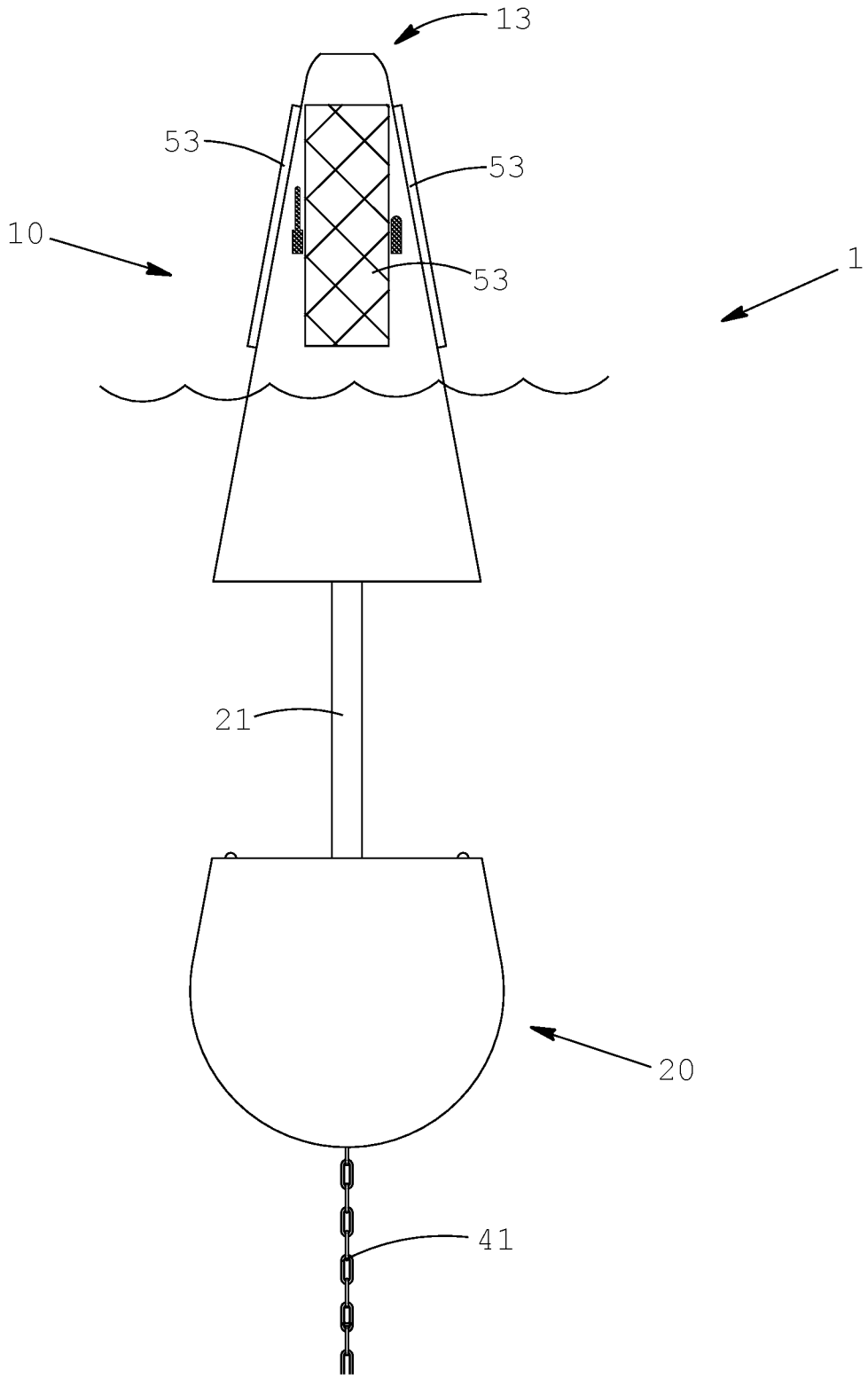
FIG. 2 is a detailed side view of the buoy of FIG. 1, but in a condition with mooring unavailable.

With reference to the accompanying figures, the reference numeral 1 indicates as a whole a mooring buoy that can advantageously, but not exclusively, be employed in a buoy field or mooring field.

As illustrated in FIG. 1, the buoy 1 is connected to a deadweight 40, placed on the bed, through an anchor line 41, such as a chain, ropes or the like. Said anchor line can be connected to the second body 20, as illustrated in the variants of FIGS. 1-5, or to the first body 10, as visible in FIGS. 6 and 7.

The buoy 1 comprises at least one first floating body 10, i.e., a body that when immersed in water, has at least one portion that emerges from the surface. Preferably, said first body 10 has a cone or truncated-cone shape, with the section decreasing toward the upper end. This shape, besides ensuring better stability to the body, allowing it to maintain as much as possible a substantially vertical position, makes it impossible or in any case difficult to fix a mooring line around it. In fact, the cone shape means that it is easy for a line to slip off it, making mooring unsafe. As will be more apparent below, this solution helps to prevent unauthorized mooring to the buoy.

According to the invention, the buoy 1 further comprises a second body 20, slidingly connected to the first body 10 along an axis of movement. More precisely, the second body 20 is placed under the first body 10 when the buoy is in a rest position or is substantially vertical. Therefore, this second body 20 is normally submerged. Said sliding axis, when the buoy is in the aforesaid rest condition, is preferably substantially vertical.

According to a preferred embodiment, the second body 20 is connected solidly to a rod 21 adapted to slide in a cavity 11 that passes through the first body 10 from a lower end 12 to an upper end 13.

Typically, said cavity 11 is isolated from the inner volume 15 of the first body, in which the components of the buoy described below are arranged.

The rod 21 is, preferably, but not necessarily, cylindrical in shape. Moreover, the rod 21 can be solid or internally hollow.

A connecting element 23 to which the line of the vessel to be moored to the buoy 1 can be fixed is present at the top end 21*a* of the rod 21. Said connecting element 23 can, for example, comprise an annular body fixed to the end 21*a* of the rod or to a through hole produced directly in the rod 21, as in the example illustrated in the figures.

According to the invention, the connecting element 23 is movable, following the mutual movement of the first body 10 and of the second body 20, between two positions, respectively retracted and protruding.

In the first, the connecting element 23 is housed in a seat 14 of the first body and returns completely into the profile of this latter (FIGS. 3*a*, 4, 5*a*, 7). Therefore, in this position the connecting element is not accessible from the outside and the mooring line cannot be fixed.

Instead, in the protruding position said connecting means 23 protrudes from the top end 13 of the first body 10, (FIGS. 3*b*, 5*b*, 6*b*) and is accessible for fixing the mooring line.

The movement of the connecting element 23 is produced by means of the rod 21 on which it is produced or to which it is solidly connected through connecting elements.

According to the invention the length of the rod 21 can be selected so as to take the connecting element 23, in the aforesaid protruding position, to a height that facilitates fixing of the mooring line even when the vessel is of medium or large size. For example, the rod 21 can have a length even of two meters or more, so that the connecting element 23, in the protruding position, can be taken to the height from the surface of the water of up to two meters.

As will be better described below, the buoy is configured to carry and maintain the connecting element 23, besides in the aforesaid retracted and protruding positions, also in intermediate positions, so that the height of said connecting element 23 is adaptable to the size of the vessel, i.e., to the height of the bridge.

According to the invention the movement of the connecting element is obtained by the mutual movement of the first and second bodies.

According to a first embodiment of the invention, the second body 20 is configured to vary its sinking depth with respect to the first body 10, which instead maintains a substantially stable floating condition. Therefore, the movement of the second body 20 causes the movement of the rod 21 and consequently of the connecting element 23.

According to this embodiment, sinking of the second body 20 is implemented varying its weight by feeding water into it or, vice versa, removing water from it. For this purpose, the second body 20 is at least partially hollow so as to define a chamber 22 into which to feed the water.

The outer volume of the second body 20 is instead substantially invariable, so as to maintain the buoyancy force that acts thereon constant.

The variation of the weight, with the same buoyancy force, therefore determines sinking of the second body to a greater or lesser depth.

Typically, the volume of the second body 20 coincides with that of the chamber 22. The second body 20 is preferably axisymmetric in shape, for example conical, with the vertex facing downward, cylindrical, spherical or partially spherical, as in the example of the figures.

The chamber 22 is filled and emptied by means of a fluid circuit, indicated as a whole with the reference numeral 30.

According to a possible embodiment, filling of the chamber takes place by exploiting the pressure of the water surrounding the second body 20. More precisely, the chamber 22 is provided with a passage 32, communicating with the outside, provided with a closing valve 31. The valve 31 is preferably a solenoid valve.

By opening the valve 31 it is therefore possible to load water into the chamber 22.

Figure 3A:
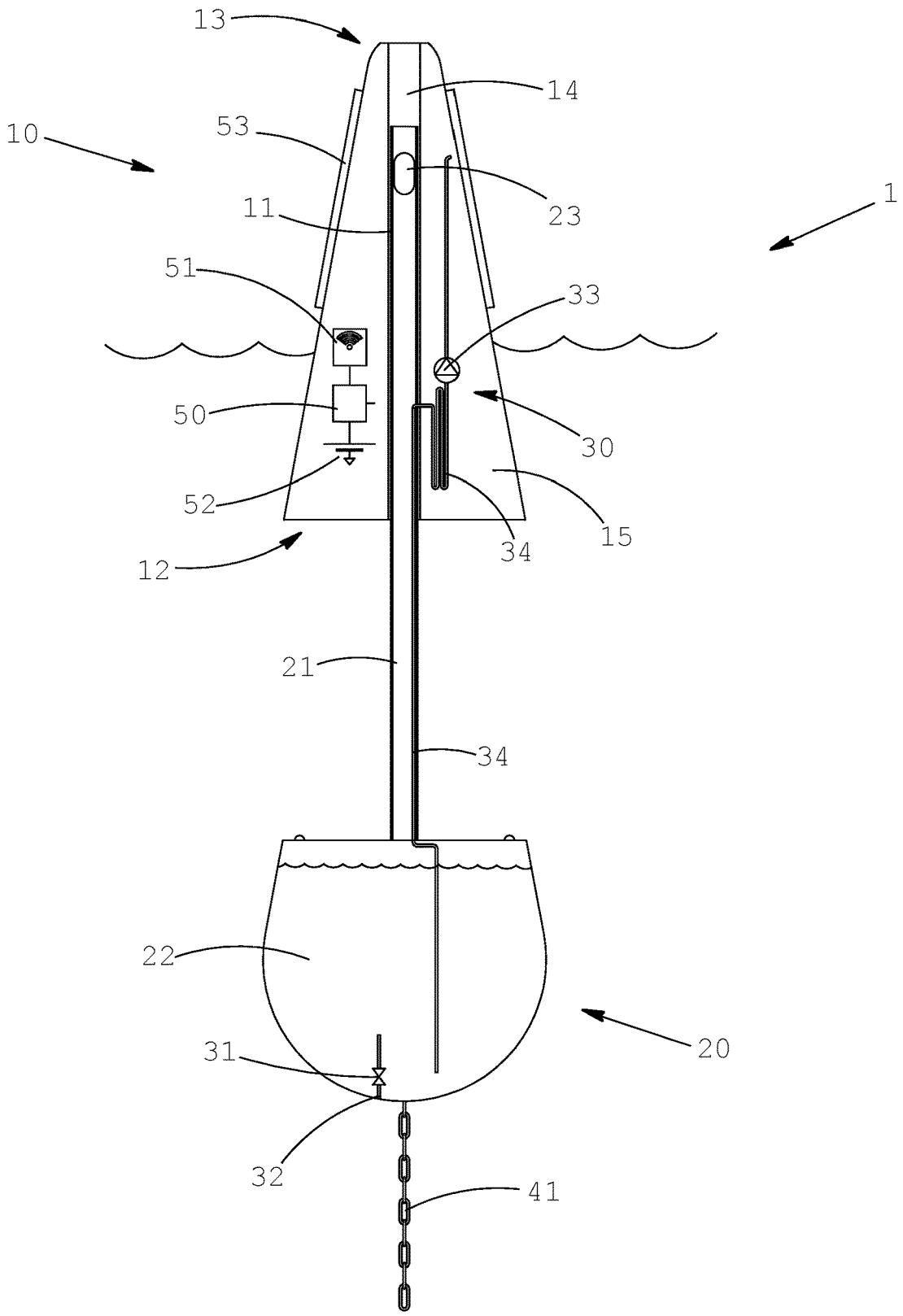
FIGS. 3*a* and 3*b* are sectional views of the buoy of FIG. 1, respectively in the conditions with mooring unavailable and mooring available.

In the example of FIG. 3*a*, the chamber 22 is almost totally filled with water, the second body 20 is in a position close to maximum sinking and the connecting element 23 is in the seat 14 in retracted position.

According to a first variant of the invention, emptying the chamber 22 takes place by pumping the water via a pump 33 from the inside of the chamber 22 toward the outside.

Figure 3B:
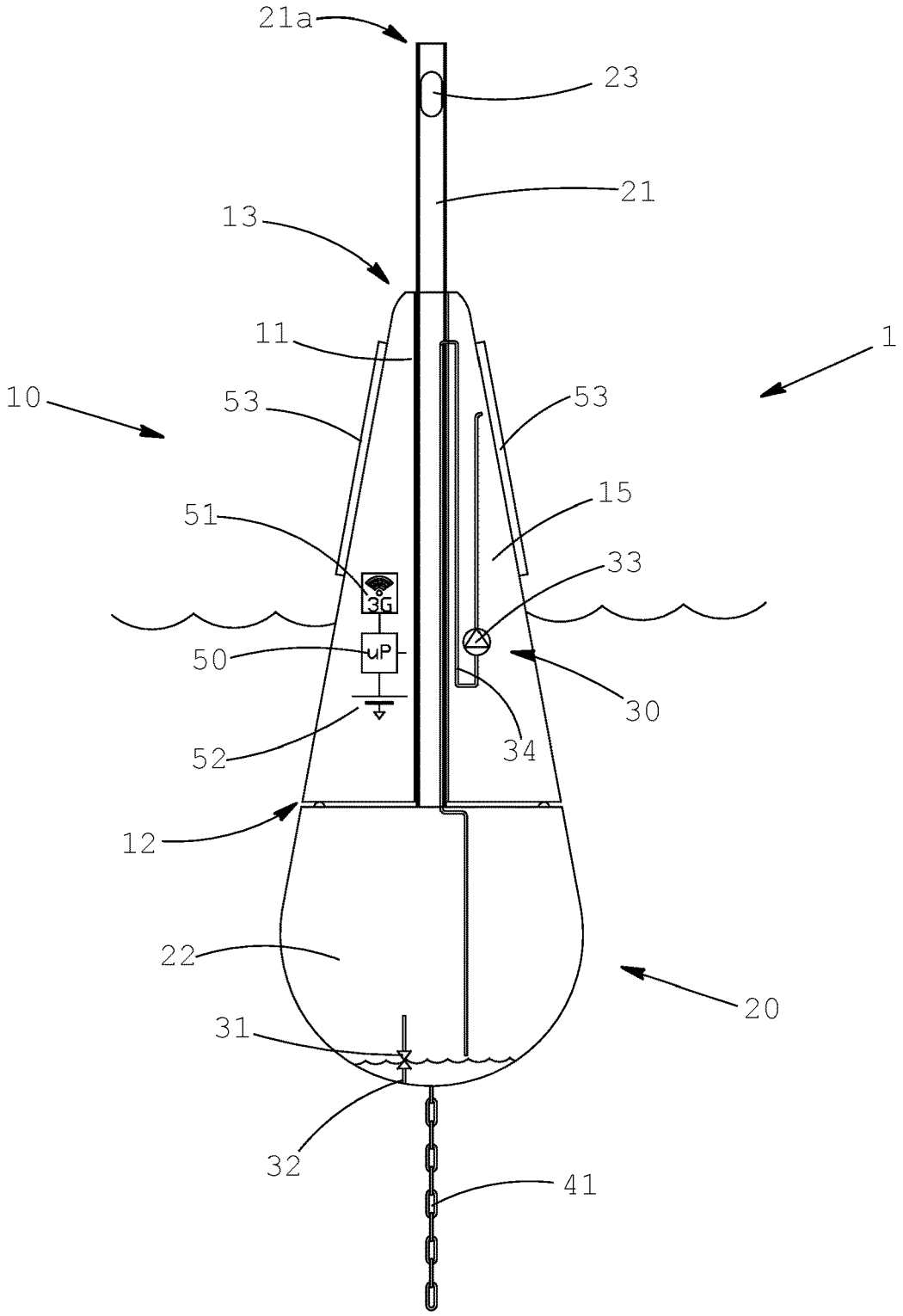

The gradual reduction of the mass of the second body 20 means that it starts to rise upward pushing the rod 21 and the connecting element 23 toward the protruding position, as can be seen in FIG. 3*b*.

According to an alternative variant, the water is removed by means of a compressor 33 that feeds compressed air into the chamber 22. Simultaneously, the valve 31 that regulates the passage 32 is opened. In this way, the pressure of the air that acts on the surface of the water in the chamber 22, which must be greater than the pressure of the water that surrounds the body, pushes the water present in the chamber 22 toward the outside through the passage 32.

If necessary, the removal of the water can take place through a further passage and related valve, not illustrated in the figures.

In the example of FIGS. 3*a*, 3*b*, the pump 33, or the compressor 33, is housed in the first body 10 and is placed in communication with the chamber 22 through a pipe 34 housed in the cavity inside the rod 21.

Cables or other connecting elements for controlling the valve 31 can also be housed in the rod 21.

Figure 4:
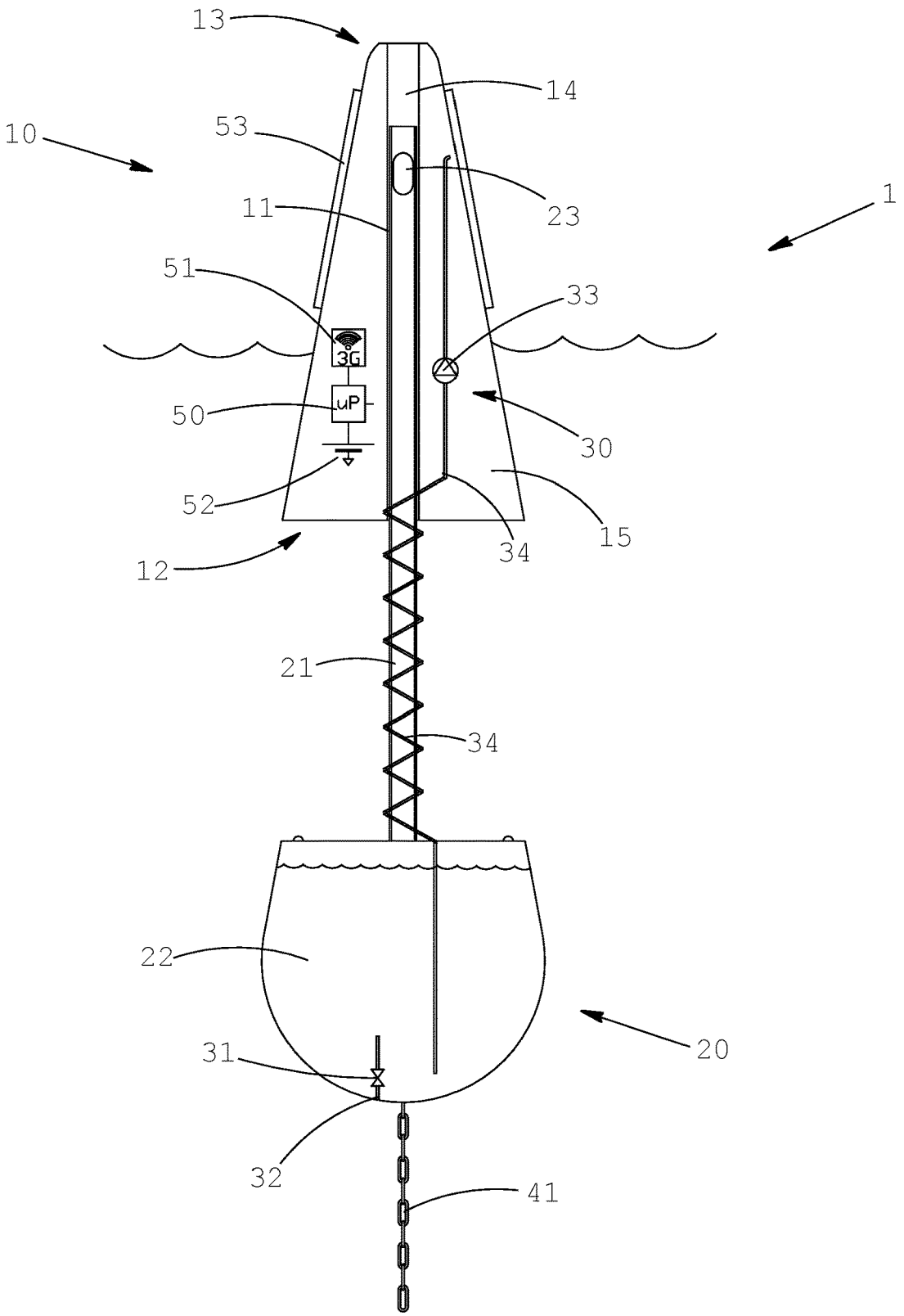
FIG. 4 is a sectional view of the buoy according to another variant of the invention, in the condition with mooring unavailable.

According to an alternative variant, illustrated in FIG. 4, the pipe 34 is wound in a coil around the rod 21 so as to be able to lengthen or extend, or retract, following the movement of the second body 20 with respect to the first body 10.

Figure 5A:
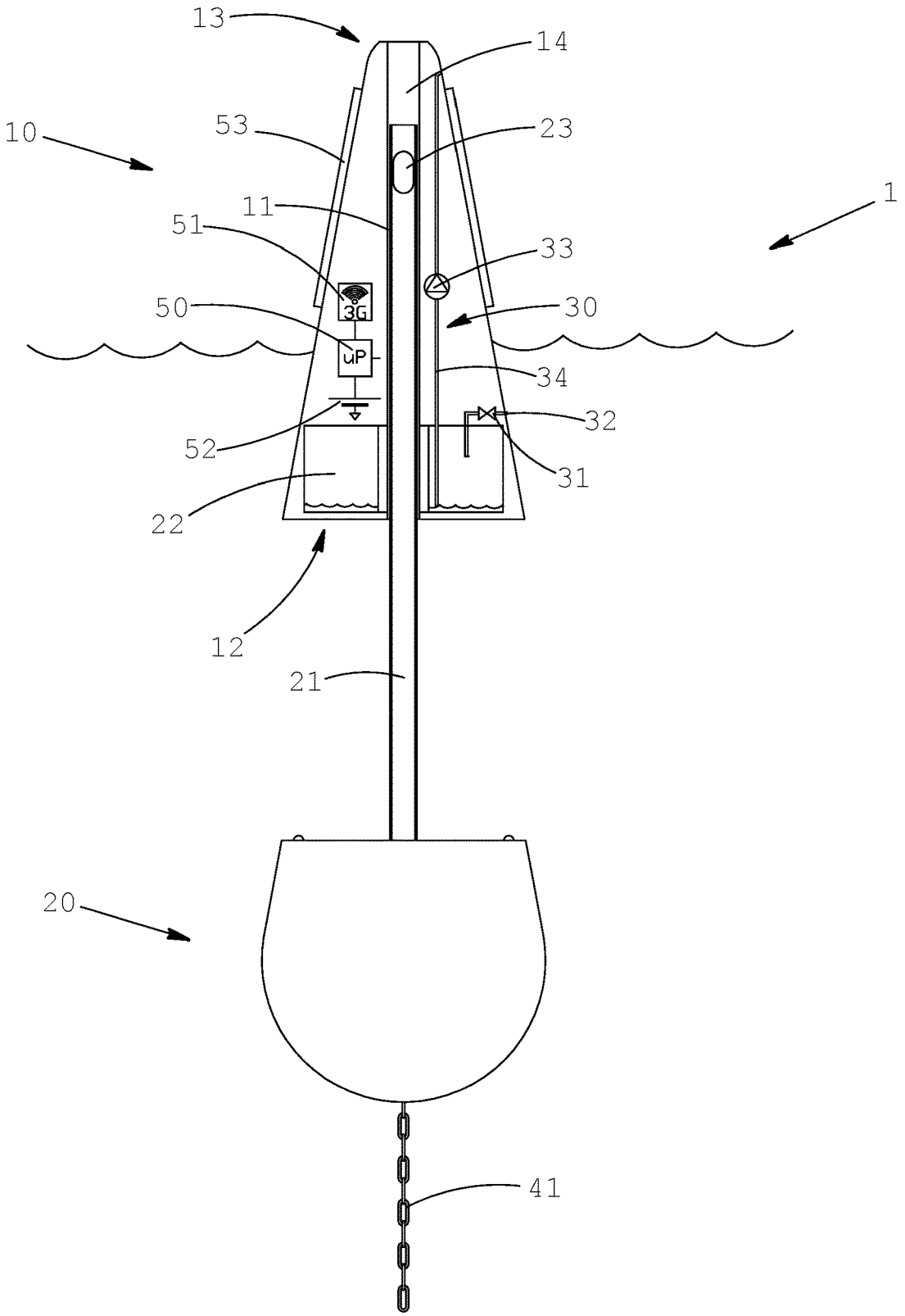
FIGS. 5*a* and 5*b* are sectional views of the buoy according to a further embodiment, respectively in a condition with mooring unavailable and mooring available.
Figure 5B:
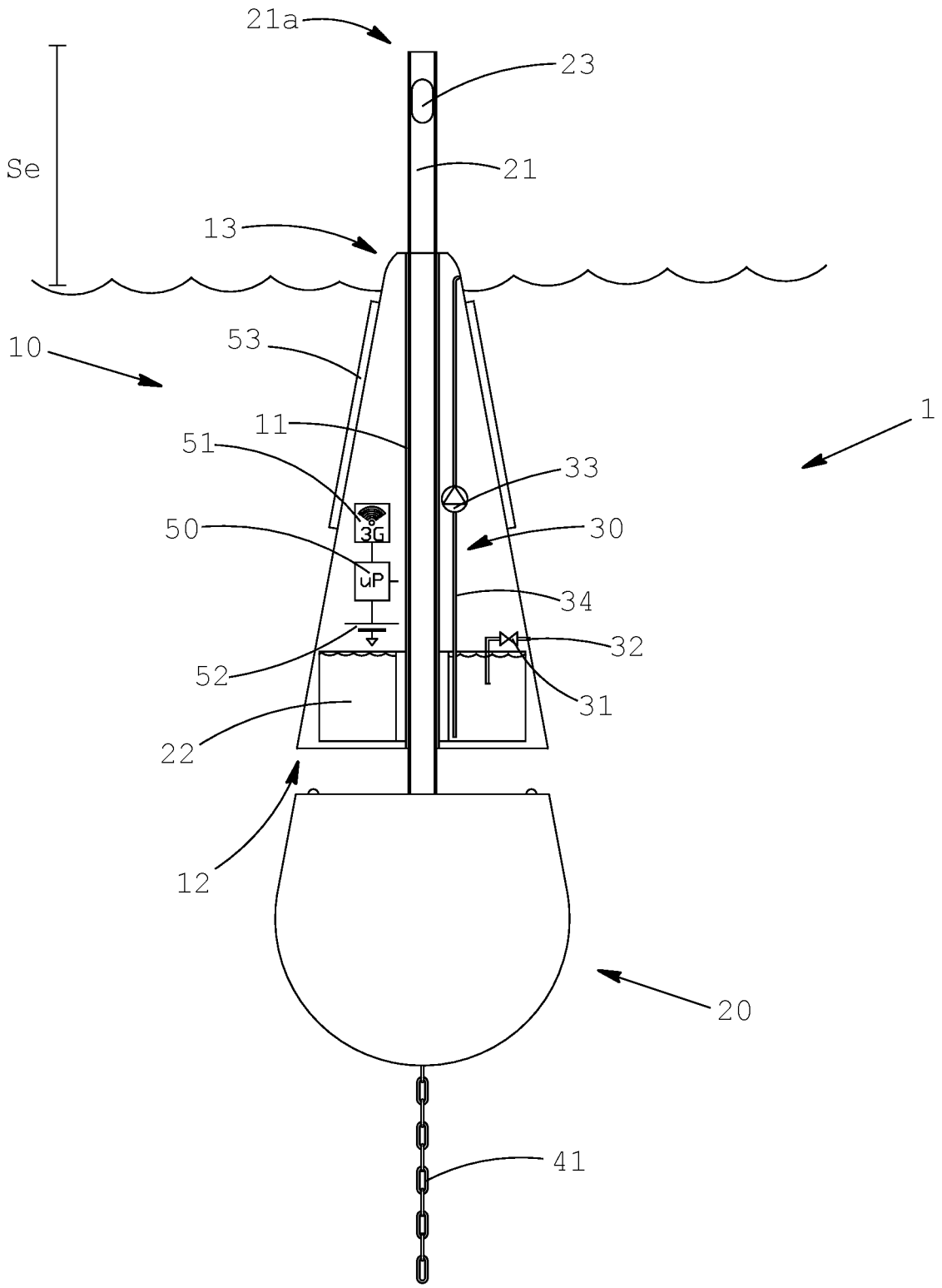

According to another possible embodiment of the invention, the movement of the connecting element 23 is produced by varying the level of sinking of the first body 10 with respect to the second body 20, as illustrated in FIGS. 5*a* and 5*b*.

In this variant the chamber 22 is placed in the first body 10. Typically, the chamber 22 is delimited by a tank or the like preferably placed in the lower part of the first body 10. If necessary, the chamber 22 can comprise several tanks or compartments.

Filling and emptying of the chamber 22 takes place in the same way described for the embodiment described previously. Also the pumping means 33 are the same as those described above.

In this variant, the second body 20 has a mass to volume ratio that enables it to float in water. However, the second body 20 is maintained submerged by the anchor line 41 to which it is connected, the length of which is calculated so as to be substantially completely in tension when the body is submerged at an established depth.

Instead, the rod 21 has a section Se emerging from the surface of the water. This section Se emerging from the surface of the water has a length that can vary from a few tens of centimeters up to a meter or more.

In the example of FIG. 5*a* the chamber 22 is empty or only partially filled with water so that the first body 10 has a floating depth such that the rod 21 and the connecting element 23 are completely inside the cavity 11 and the seat 14, respectively.

The introduction of water into the chamber 22 takes place either through the passage 32 that is controlled by the valve 31, or, if necessary, through direct suction of the water via the pump 33. Filling of the chamber 22 with water causes an increase in the weight of the first body 10, which therefore starts to sink sliding along the rod 21. In this step the section Se above the surface of the water protrudes gradually more and more from the top end 13 of the first body, until the connecting element 23 becomes accessible.

Preferably, the connecting element 23, in the retracted position, is located at a distance of around 30-60 cm under the top end 13 of the first body 10.

In this way a user who attempts to purposely sink the first body 10, to moor without authorization, is prevented from releasing the connecting element 23 to fix the line of the vessel to it.

Figure 6B:
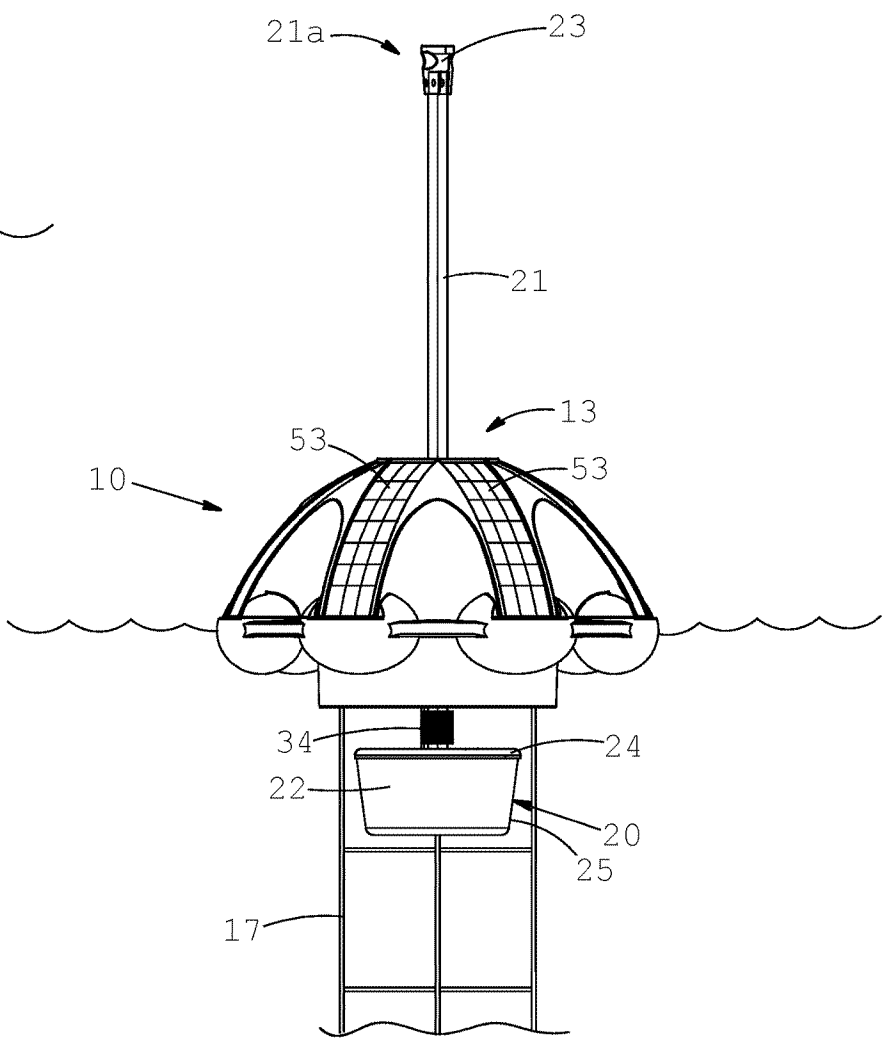
FIGS. 6*a* and 6*b* are side views of the buoy according to a further embodiment, respectively in a condition with mooring unavailable and mooring available.
Figure 6A:
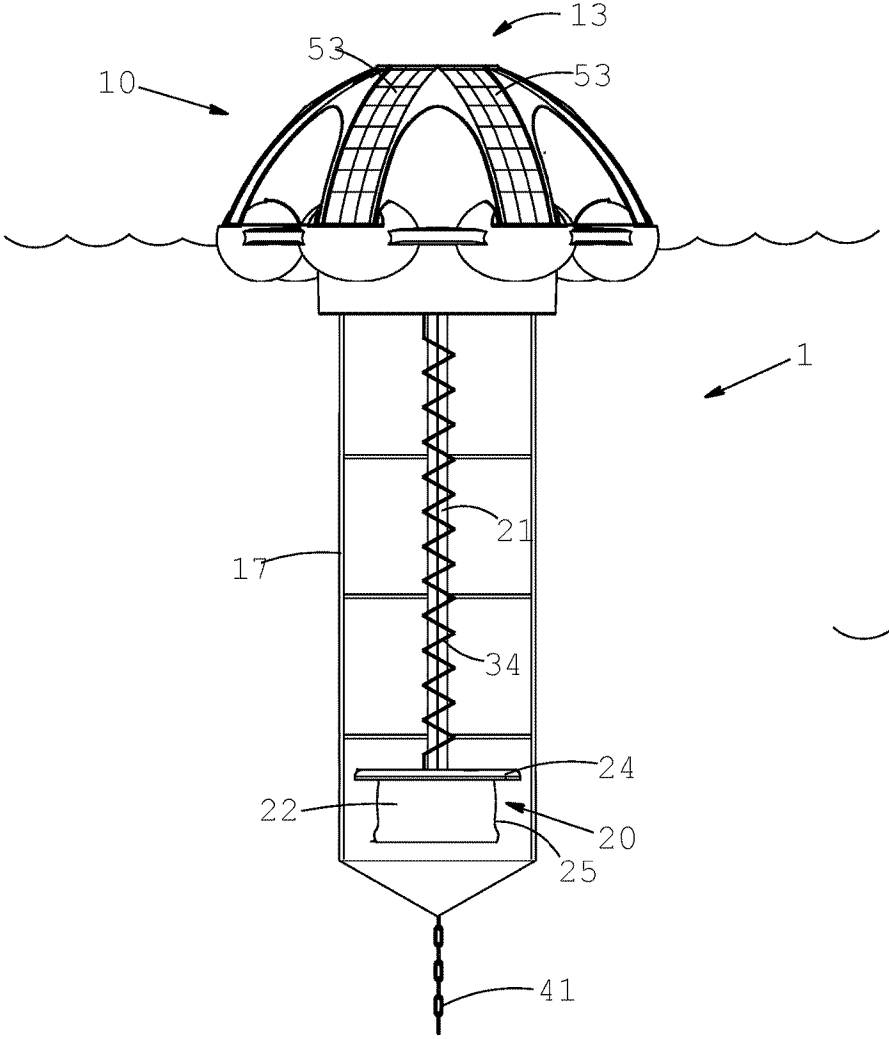
Figure 7:
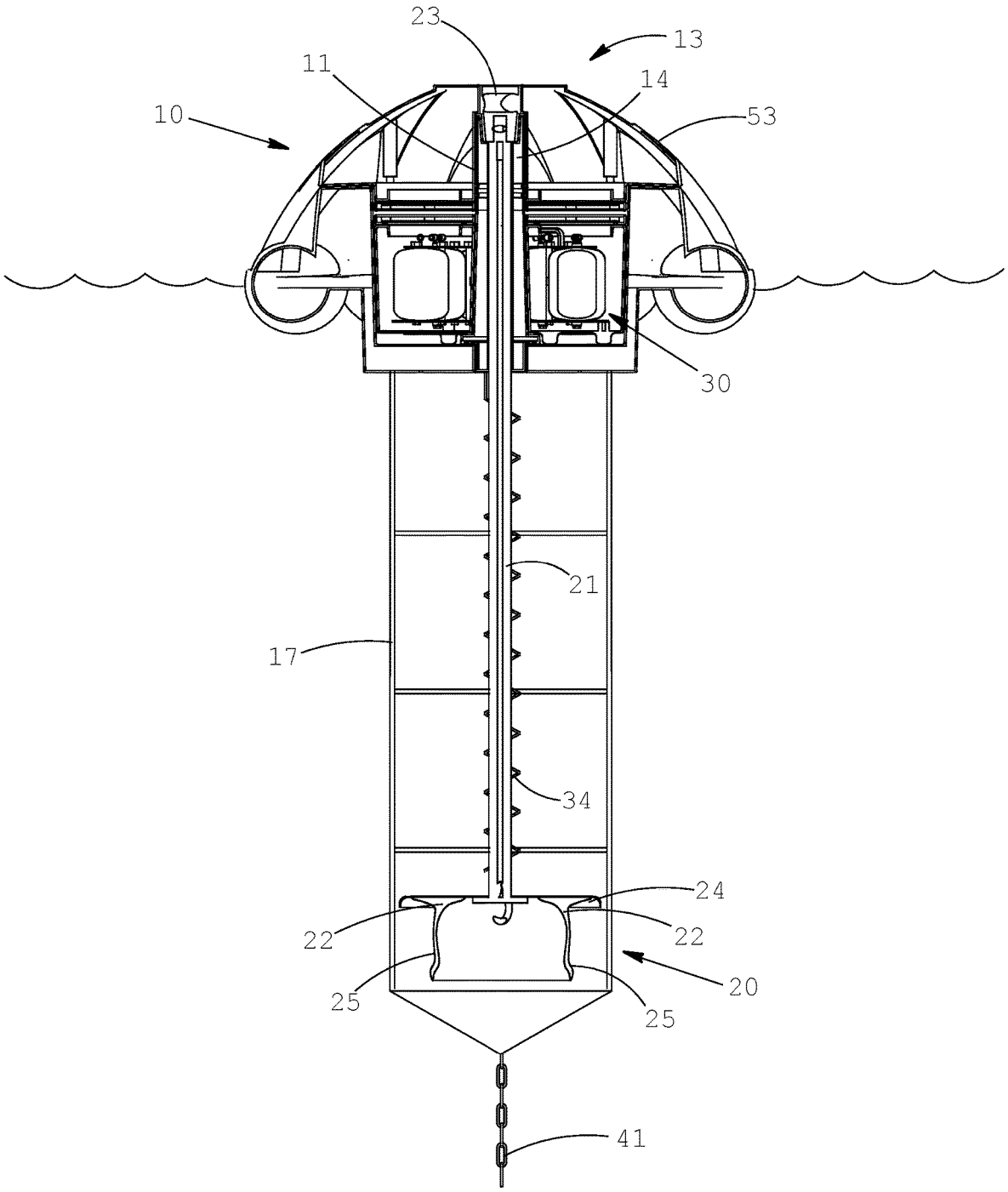
FIG. 7 is a sectional view of the buoy of FIG. 6*a;*

FIGS. 6*a*, 6*b* and 7 illustrate the buoy 1 according to a further embodiment.

Also in this variant the chamber 22 is produced in the second body 20 and the components of the fluid circuit are placed in the first body 10. The control unit, the communication module and other electric or electronic components are also preferably located in the first body 10.

The body 10 is connected to the anchor line 41 by means of a cage frame 17 that encloses the second body 20.

In this variant the second body 20 comprises a rigid support 24 to which a flexible membrane 25 is fixed. Said flexible membrane 25 can comprise a single continuous closed wall that defines the chamber 22 or this latter is comprised between the flexible membrane and the rigid support 24. The rigid support 24 is in turn connected to the rod 21.

The membrane 25 is made of a flexible and even elastic material.

The flexible material used for the buoy according to the present invention is selected from materials impermeable to air, to water, or to both. Typically, said material is a single layer or multiple layer polymer material.

The fluid circuit is configured to introduce compressed air into the chamber 22 to increase its volume or, on the contrary, to allow its removal and consequently reduce its volume. The membrane 25 is immersed and in contact with the body of water in which the buoy is located. Therefore, a variation of the volume of the chamber 22 corresponds to a variation of the total volume of the second body 20. As explained above, a larger or smaller volume of the second body 20 determines the generation of a more or less intense buoyancy that causes raising or lowering of said second body with respect to the first body.

Figure 8:
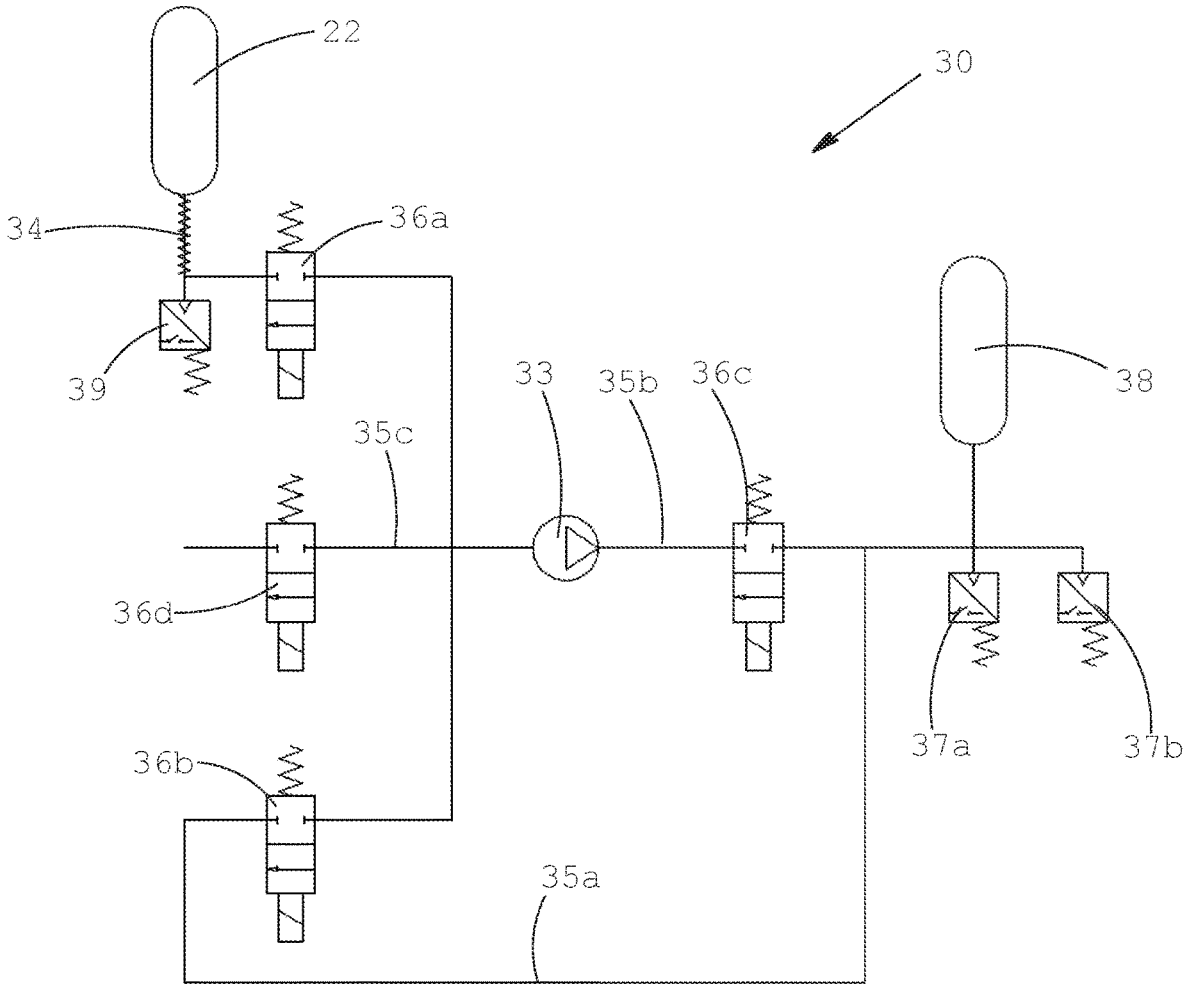
FIG. 8 is a schematic view of the fluid circuit of the buoy, according to a variant of the invention.

An example of the fluid circuit 30 that can be used with the buoy according to this embodiment is illustrated in FIG. 8.

The circuit 30 comprises a tank 38 in communication with the chamber 22 through a delivery pipe 35*a*. Said pipe 35*a* is intercepted by two valves 36*a*, 36*b*. The tank 38 is in turn connected to a compressor 33 through a delivery pipe 35*b* intercepted by a valve 36*c*. Said delivery pipe 35*b* is coupled to the pipe 35*a* with a T-fitting. The suction pipe 35*c* of the compressor is equipped with a valve 36*d* and is coupled to the pipe 35*a* with a four-way fitting.

According to a preferred variant said valves are preferably of 3/2 way type, and can be monostable normally closed, as in the example in the figure, or bistable. Moreover, said valves are typically all solenoid valves.

When the valves 36*a*, 36*b* are open, the chamber 22 is in fluid communication with the tank 38. If the pressure in the tank 38 is initially higher than the pressure in the chamber 22, the air transfers from the first to the second, until reaching a pressure balance or, in any case, a pressure sufficient to cause the second body 20 to rise.

This operation enables the chamber 22 to be inflated so that the body and the rod 21 are raised and the connecting element 23 is released (FIG. 6*b*). After reaching the desired height, the valves 36*a*, 36*b* are closed, to maintain the pressure inside the chamber 22.

From the raised position, in order to lower the second body 20 the valves 36*a* and 36*c* are opened and the compressor 33 is activated to pump the air present in the chamber 22 into the tank 38. After lowering has terminated, the valves 36*a* and 36*c* are closed again and the compressor 33 is deactivated.

The circuit preferably also comprises a pair of pressure switches adapted to measure the pressure in the tank 38. In particular, a first pressure switch 37*a* is calibrated to a minimum pressure threshold and a pressure switch 37*b* is calibrated to a maximum pressure threshold.

When the pressure drops below the minimum threshold detected by the pressure switch 37*a*, the compressor 33 is activated and the valves 36*c* and 36*d* are opened to enable the suction of air from outside toward the tank 38. After reaching the maximum pressure threshold detected by the pressure switch 37*b*, the compressor is switched off and the valves 36*c*, 36*d* closed again.

The circuit is also preferably equipped with a linear pressure transducer 39 adapted to read the pressure inside the chamber 22. By means of said linear pressure transducer it is possible to set a given pressure to be maintained inside the chamber 22. This pressure measurement enables both measuring the pressure necessary to raise the second body 20, and setting and maintaining a pressure value that enables the second body 20, and consequently the connecting element 23, to remain in an intermediate position between the completely retracted and the completely extended positions.

In all the variants described, the buoy 1 comprises a control unit 50 that controls the various components of the fluid circuit, such as the pumps or the compressors, the valves and other electric or electronic components of the circuit.

To be able to control the buoy remotely, it is preferably equipped with a communication module 51, connected to the control unit 50, configured to communicate with an external electronic device from which it can receive commands, for example a command to authorize mooring.

The communication module is preferably wireless, for example of Wi-Fi, data network (GPRS, 3G, 4G, etc.) or Bluetooth type.

The external electronic device can be a portable device, such as a smartphone, a tablet, etc., which can be used by the boater wishing to moor or by the personnel of the buoy field, and also a central control unit of a control station of the buoy field.

The power of the control unit 50, of the communication module 51, of the components of the fluid circuit 30 and of any other electric or electronic component on board is supplied by a battery 52. Said battery 52 can be charged by solar panels 53 attachable to the outer surface of the first body 10.

Preferably, the battery 52 is housed in the first body 10, as shown in FIGS. 3-5. Alternatively, if the battery is of large size, it can be placed in the deadweight 40 to reduce the weight of the first body 10.

Following an authorization procedure requested by the boater, it is possible to generate a control signal to send to the communication module 51 to activate the pumping means and open the valves of the fluid circuit. The request for authorization and any payment required can be made using known methods (credit cards, PayPal® or the like), typically through a website of the buoy field or through an application installable on the portable device.

Preferably, the control unit 50 can be managed directly by the boater's device. For example, in the variants of FIGS. 1-4 and 6-7, it is possible to control the height to which the connecting element 23 is raised so as to take it to the most convenient height for fixing the line of each vessel.

After the line has been connected, the rod 21 and the connecting element 23 can be withdrawn into a withdrawn position next to the retracted position, so that there is no risk of the rod 21 impacting against the hull of the vessel during the mooring period.

After the mooring period has terminated and the line has been removed, the connecting element 23 can be returned to the retracted position sending a command to the control unit 50, generated by the boater's portable device or by the central control unit, to control the valves and/or the pumping means of the circuit 30.

The invention has been described purely for illustrative and non-limiting purposes, according to some preferred embodiments. Those skilled in the art may find numerous other embodiments and variants, all falling within the scope of protection of the claims below.

The invention claimed is:

1. A mooring buoy (1), comprising:

a first body (10) capable of floating;

a second body (20) placed under the first body (10), said first and second bodies being slidingly connected, said second body (20) being normally submerged when the buoy is in use and in a rest position;

a connecting element (23) connected to the second body (20) and fixable to a mooring line of a vessel to be moored to the buoy (1), said connecting element (23) being housed in a seat (14) produced in the first body (10) and being movable, due to an effect of movement of the first and second bodies, between a retracted position, in which the connecting element (23) returns into a profile of the first body (10), and a protruding position, in which the connecting element (23) protrudes from the top end (13) of the first body (10) thereby enabling the mooring line to be fixed to the buoy (1);

at least one chamber (22) located in any of the second body (20) and the first body (10);

a fluid circuit (30) for feeding a fluid into the chamber (22) or, vice versa, for removing the fluid from said chamber (22) toward the outside; and a control unit (50) connected to said fluid circuit (24), wherein the control unit controls the fluid circuit (30) to vary an amount of said fluid in the chamber (22) so as to cause a variation of an immersion depth of the first body (10) with respect to the second body (20) or vice versa and, consequently, move the connecting element (23) between the retracted and protruding positions.

2. The mooring buoy (1) according to claim 1, wherein said fluid is air or water.

3. The mooring buoy (1) according to claim 1, wherein a variation of the amount of said fluid in the chamber (22) causes a variation of the weight or of a volume of said first body (10) or said second body (20).

4. The mooring buoy (1) according to claim 1, wherein the fluid circuit (30) comprises pumping means adapted to input air into the chamber (22) and allow the air to be removed.

5. The mooring buoy (1) according to claim 4, wherein a volume of the chamber (22) is variable.

6. The mooring buoy (1) according to claim 5, wherein the chamber (22) is delimited by one or more walls (25) at least partially submerged and directly in contact with water in which the mooring buoy is immersed (1).

7. The mooring buoy (1) according to claim 6, wherein said one or more walls (25) of the chamber (22) are made of a flexible or elastic material.

8. The mooring buoy (1) according to claim 4, wherein said chamber (22) has a constant volume.

9. The mooring buoy (1) according to claim 1, wherein the fluid circuit (30) comprises pumping means to move water from inside the chamber (22) toward the outside of the mooring buoy (1) or also from outside the mooring buoy (1) toward the inside of the chamber (22).

10. The mooring buoy (1) according to claim 1, wherein said chamber (22) is comprised in the second body (20).

11. The mooring buoy (1) according to claim 10, wherein the fluid circuit (30) is housed in the first body (10).

12. The mooring buoy (1) according to claim 11, wherein the chamber (22) is connected to the fluid circuit (30) by means of a flexible pipe (34).

13. The mooring buoy (1) according to claim 1, wherein the first body (10) and the second body (20) are connected by a rod (21), said rod (21) being solidly connected to the second body (20) and being mounted sliding in a cavity (11) produced in the first body (10).

14. The mooring buoy (1) according to claim 13, wherein the connecting element (23) is connected to said rod (21).

15. The mooring buoy (1) according to claim 1, further comprising:

a communication module (51), connected to the control unit (50), configured to communicate with an external electronic device or with a control center, so as to receive commands for controlling the fluid circuit (30).

16. The mooring buoy (1) according to claim 1, further comprising:

at least one battery (52), solar panels (53) adapted to recharge said battery (52), and a charging circuit.

17. The mooring buoy (1) according to claim 2, wherein a variation of the amount of said fluid in the chamber (22) causes a variation of the weight or of a volume of said first body (10) or said second body (20).

18. The mooring buoy (1) according to claim 2, wherein the fluid circuit (30) comprises pumping means adapted to input air into the chamber (22) and allow the air to be removed.

19. The mooring buoy (1) according to claim 3, wherein the fluid circuit (30) comprises pumping means adapted to input air into the chamber (22) and allow the air to be removed.

20. The mooring buoy (1) according to claim 2, wherein the fluid circuit (30) comprises pumping means to move water from inside the chamber (22) toward the outside of the mooring buoy (1) or also from outside the mooring buoy (1) toward the inside of the chamber (22).

* * * * *